US007154058B2

(12) United States Patent
Kim et al.

(10) Patent No.: US 7,154,058 B2
(45) Date of Patent: Dec. 26, 2006

(54) DOOR SWITCH ASSEMBLY FOR WASHING MACHINE AND DRYER

(75) Inventors: Seong Kyu Kim, Gyeongsangnam-do (KR); Soo Won Park, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/033,843

(22) Filed: Jan. 13, 2005

(65) Prior Publication Data

US 2006/0005997 A1 Jan. 12, 2006

(30) Foreign Application Priority Data

Jul. 8, 2004 (KR) ..... 10-2004-0053032

(51) Int. Cl.
*H01H 3/16* (2006.01)
*H01H 13/06* (2006.01)

(52) U.S. Cl. ..... 200/302.1; 200/61.76; 200/61.81; 200/302.2

(58) Field of Classification Search .. 200/61.41–61.43, 200/61.62, 61.7, 61.71, 61.73–61.76, 61.81, 200/61.82, 302.1, 302.2
See application file for complete search history.

(56) References Cited

U.S. PATENT DOCUMENTS

| | | | | | |
|---|---|---|---|---|---|
| 3,204,069 | A | * | 8/1965 | West | 200/531 |
| 3,244,829 | A | * | 4/1966 | Webb | 200/61.62 |
| 3,393,281 | A | * | 7/1968 | Basso | 200/61.62 |
| 3,676,626 | A | * | 7/1972 | Mitchell | 200/534 |
| 3,742,162 | A | * | 6/1973 | Wasemann | 200/61.62 |
| 3,887,777 | A | * | 6/1975 | Nishino | 200/61.69 |
| 4,788,517 | A | * | 11/1988 | Meister | 335/205 |
| 5,959,271 | A | * | 9/1999 | Matsuhashi | 200/61.41 |

* cited by examiner

*Primary Examiner*—Michael A. Friedhofer
(74) *Attorney, Agent, or Firm*—Birch, Stewart, Kolasch, and Birch, LLP

(57) ABSTRACT

A door switch assembly for a washing machine and a dryer having improved reliability is disclosed. The door switch assembly includes a plunger movably provided in a cabinet of the dryer and pushed by a door to operate an electrical switch, an elastic member provided in the dryer, elastically supporting the plunger, and a sealing mechanism configured to prevent water from entering a clearance between the plunger and the cabinet.

17 Claims, 6 Drawing Sheets

DOOR SWITCH ASSEMBLY FOR WASHING MACHINE AND DRYER

This application claims the benefit of Korean Application No. P2004-53032, filed on Jul. 8, 2004, which is hereby incorporated by reference as if fully set forth herein.

BACKGROUND OF THE INVENTION

1. Field of the Invention

The present invention relates to a door for a washing machine and a dryer, and more particularly to a door switch assembly for a washing machine and a dryer. Although the present invention is suitable for a wide scope of applications, it is particularly suitable for detecting a closure of the door.

2. Discussion of the Related Art

Generally, a washing machine and a dryer are configured to perform washing and drying functions after their respective door is closed, for safety of a user. The washing machine and the dryer are provided with a door switch assembly to inform a controller of such a closure of the door.

The door switch assembly includes a mechanical mechanism directly operated by the door and an electrical mechanism operated by the mechanical mechanism. Therefore, if the door is closed, the mechanical mechanism is operated and the electrical mechanism generates an electrical signal depending on the operation of the mechanical mechanism to inform the controller of the washing machine or the dryer of closure of the door. The mechanical mechanism includes various mechanical elements as the case may be, and the electrical mechanism includes an electrical switch.

Meanwhile, water may enter an upper portion of a cabinet of the washing machine and the dryer for some reasons. Particularly, since the washing machine and the dryer use water of high temperature for a washing function and heat wind for a drying function, the water may be congealed on the cabinet due to temperature difference between inner and outer portions of the washing machine and the dryer. Such water may enter the door switch assembly. In such case, the electrical mechanism and other electrical elements of the washing machine and the dryer may be out of order.

SUMMARY OF THE INVENTION

Accordingly, the present invention is directed to a door switch assembly for a washing machine and a dryer that substantially obviates one or more problems due to limitations and disadvantages of the related art.

An object of the present invention is to provide a door switch assembly for a washing machine and a dryer, which prevents water from entering an inner portion of the door switch assembly.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a door switch assembly includes a plunger movably provided in a cabinet of the dryer and pushed by a door to operate an electrical switch, an elastic member provided in the dryer, elastically supporting the plunger, and a sealing mechanism configured to prevent water from entering a clearance between the plunger and the cabinet.

The sealing mechanism is provided around the plunger and includes a guide member guiding the water to detour the clearance. The guide member includes a flange radially extended from the plunger and a hub extended toward the cabinet from the flange while surrounding the plunger.

Alternatively, the sealing mechanism includes an extension portion radially extended from the end of the plunger. Preferably, the sealing mechanism further includes a sealing member provided adjacent to the extension portion at the circumference of the plunger.

More alternatively, the sealing mechanism includes an opening provided around the plunger to eject the water entering the clearance.

Still more alternatively, the sealing mechanism includes a cover formed in the door to surround the plunger when the plunger is pushed. Preferably, the cover is configured to surround the upper portion and both sides of the plunger.

In the present invention as described above, since the water fails to enter the door switch assembly, the electrical switch of the door switch assembly is prevented from being out of order.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
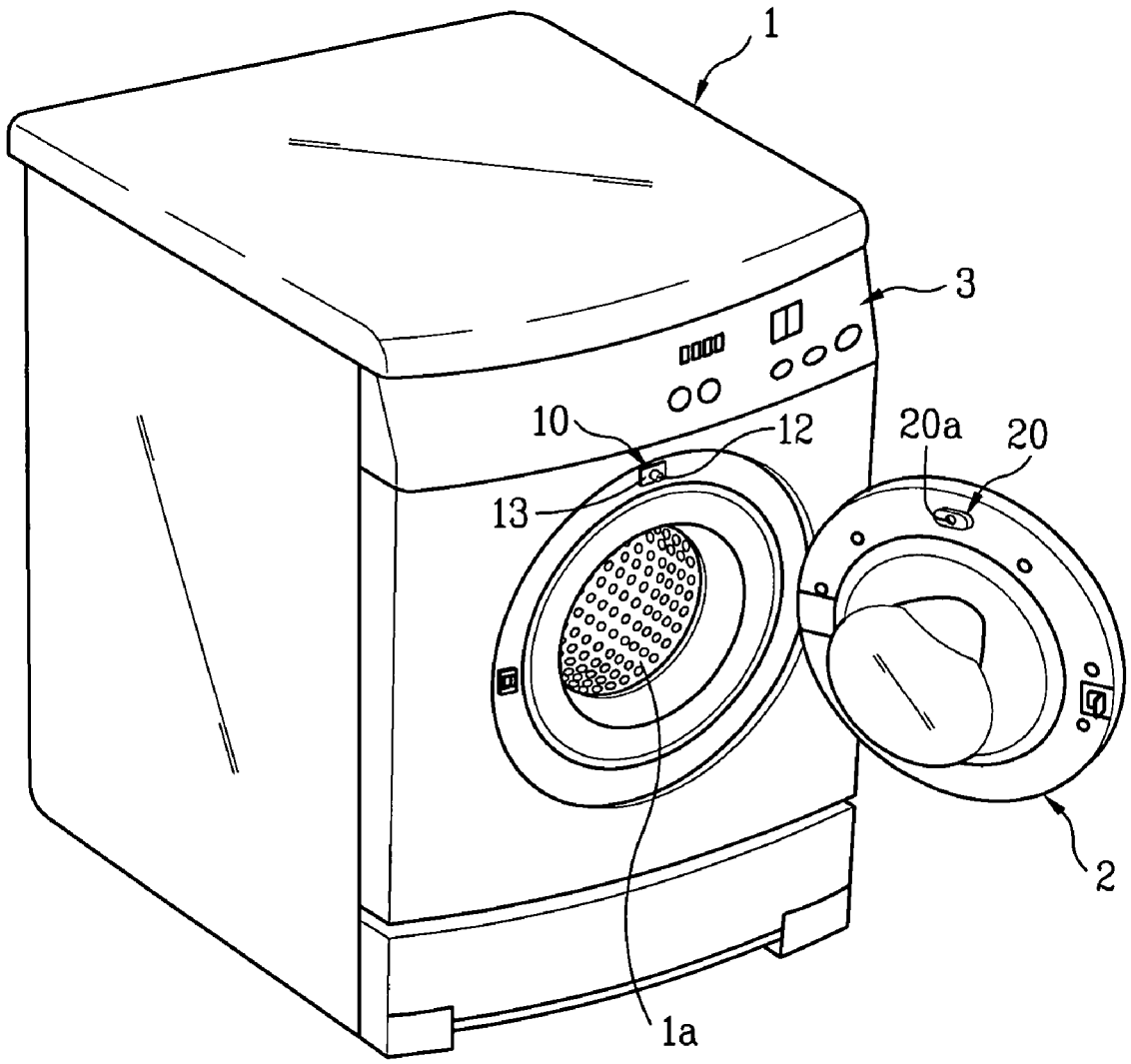
FIG. 1 is a perspective view illustrating a dryer or a washing machine with a door switch assembly according to the present invention.
Figure 2:
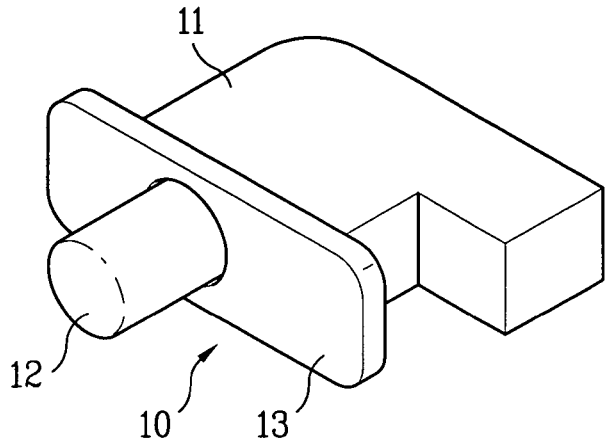
FIG. 2 and FIG. 3 are a perspective view and a partial sectional view illustrating a door switch assembly according to the present invention.
Figure 3:
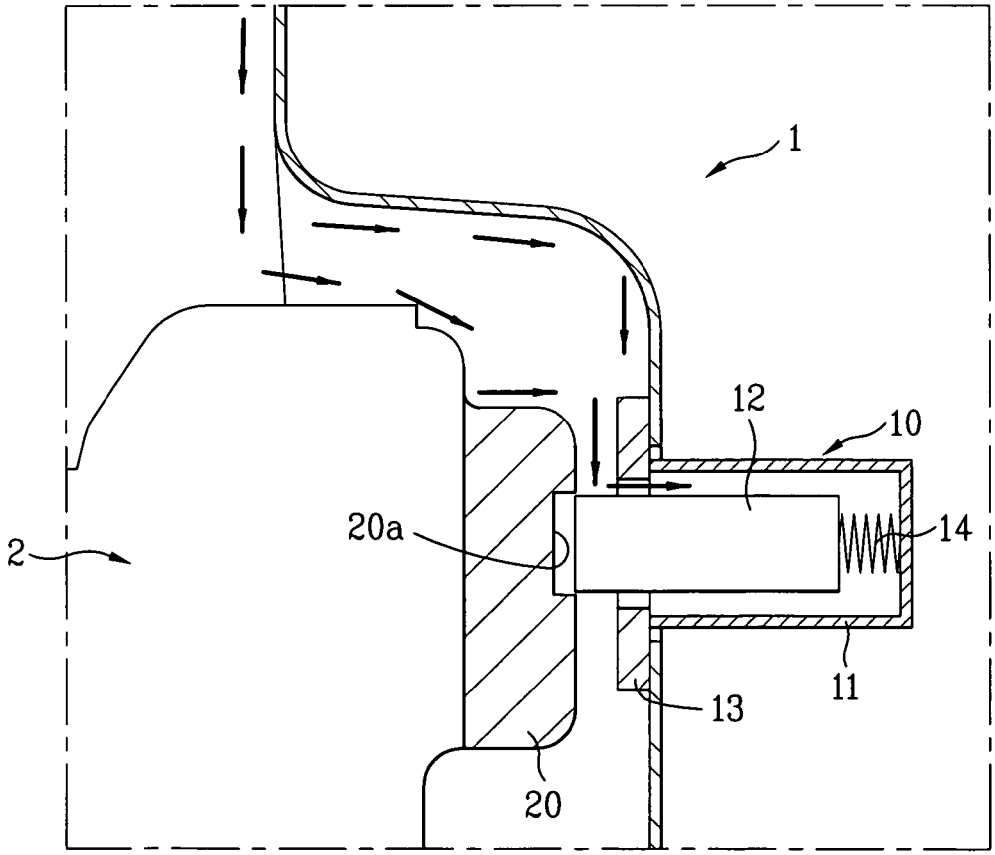

FIG. 1 is a perspective view illustrating a dryer or a washing machine with a door switch assembly according to the present invention, and FIG. 2 and FIG. 3 are a perspective view and a partial sectional view illustrating a door switch assembly according to the present invention.

Generally, a washing machine and a dryer are provided with an inlet 1*a* formed in a cabinet 1 and connected with a drum inside the cabinet land a door 2 rotatably provided in the cabinet 1 to open and close the inlet 1*a*. A control panel 3 is provided at the upper portion of the cabinet 1 to allow a user to control various operations of the washing machine and the dryer. Also, a door switch assembly 10 is provided adjacent to the inlet 1*a*.

The door switch assembly 10, as shown in FIG. 2 and FIG. 3, includes a plunger 12 movably provided in the cabinet 1 and an elastic member 14 elastically supporting the plunger 12. The plunger 12 and the elastic member such as a spring 14 are received in a housing 11 provided in the cabinet 1. A holder 13 is attached to the outer surface of the cabinet 1 and guides movement of the plunger 12. Although not shown, an electrical switch is provided adjacent to the plunger 12 so that it is to be operated by movement of the plunger 12.

The plunger 12 is protruded from the cabinet 1 to be pushed by the door 2. A push button 20 is protruded at a portion opposite to the door switch assembly 10 of the door 2 to push the plunger 12. The push button 20 includes a recess 20*a* receiving the plunger 12. The recess 20*a* serves to tightly attach the plunger 12 to the door 2 when the door is closed. The plunger 12 is pushed by the push button 20 when the door 2 is closed while it returns to the original position by means of a spring 14 when the door 2 is opened. Therefore, the pushed plunger 12 operates its adjacent electrical switch. The electrical switch sends an electrical signal indicative of closure of the door 2 to a controller of the washing machine or the dryer. Afterwards, the controller starts to perform a washing or drying function in response to the electrical signal of the electrical switch.

However, as aforementioned, water may enter the door switch assembly 10 along the cabinet 1. Particularly, as shown in FIG. 3, the water may enter the inner portion of the door switch assembly 10 through a clearance between the plunger 12 and the cabinet 1. Accordingly, the door switch assembly 10 of the present invention is provided with a sealing mechanism that prevents water from entering the clearance.

Figure 4A:
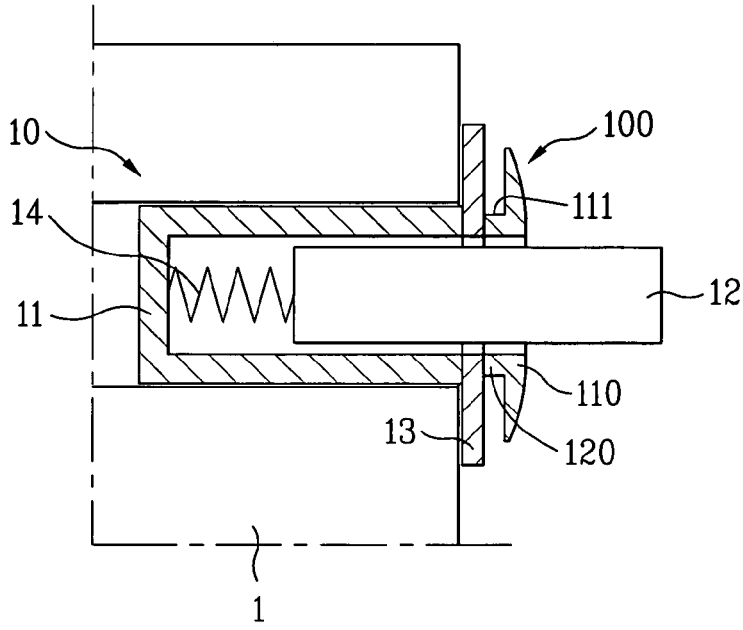
FIGS. 4A and 4B are a partial sectional view and a front view illustrating a sealing mechanism according to the first embodiment of the present invention.
Figure 4B:
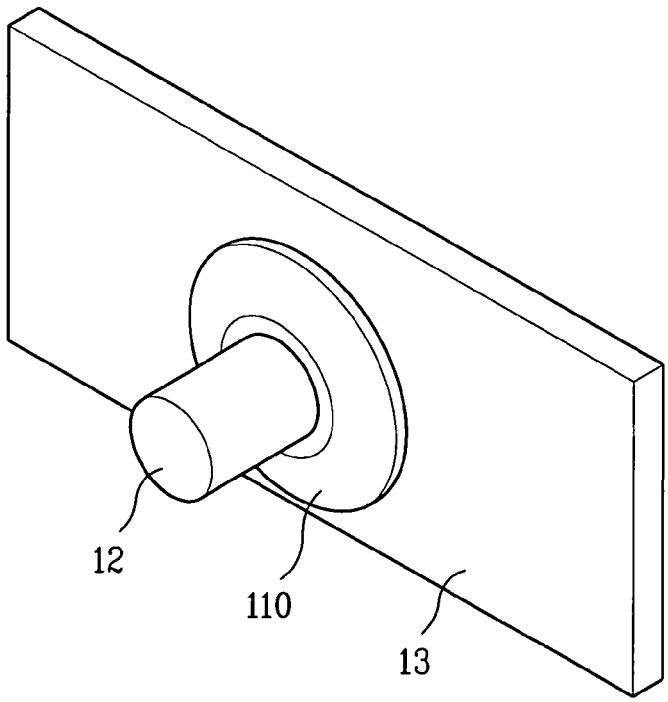

In the first embodiment of the present invention as shown in FIGS. 4A and 4B, the sealing mechanism includes a guide member 100 provided around the protruded plunger 12. The guide member 100 includes a flange 110 radially extended from the plunger 12 and a hub 120 extended toward the cabinet 1 from the flange 110 while surrounding the plunger 12. The guide member 100, as shown in FIG. 4A, is configured to have a channel section 111 along with either the holder 13 or the cabinet 1 if the holder 13 is removed. The channel section serves to substantially form a path that flows the water around the plunger 12. In this case, the guide member 100 allows the water to detour the clearance between the plunger 12 and the cabinet 1. As a result, the water fails to enter the clearance.

Meanwhile, if the guide member 100 and the holder 13 are separately provided, a fine clearance is formed between them and the water may enter the switch assembly through the clearance. Therefore, it is preferable that the guide member 100 and the holder are formed in a single body with each other to remove such a clearance.

Figure 5A:
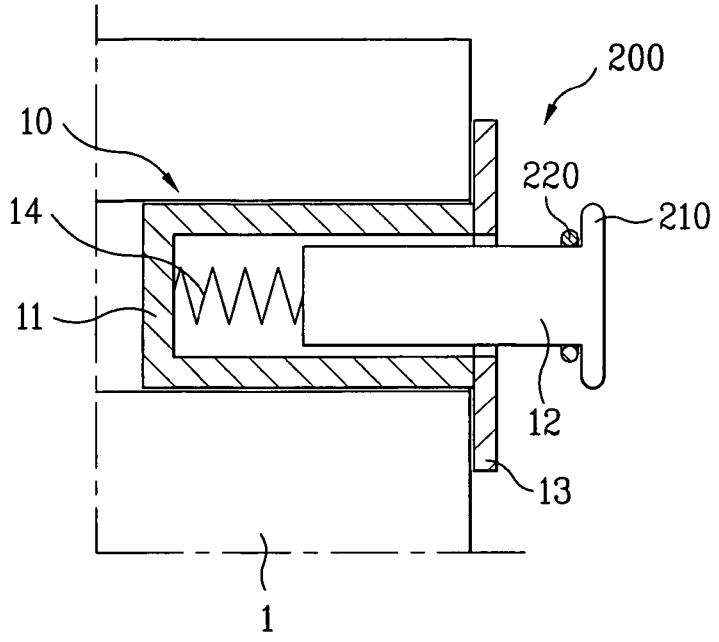
FIGS. 5A and 5B are partial sectional views illustrating a sealing mechanism according to the second embodiment of the present invention.
Figure 5B:
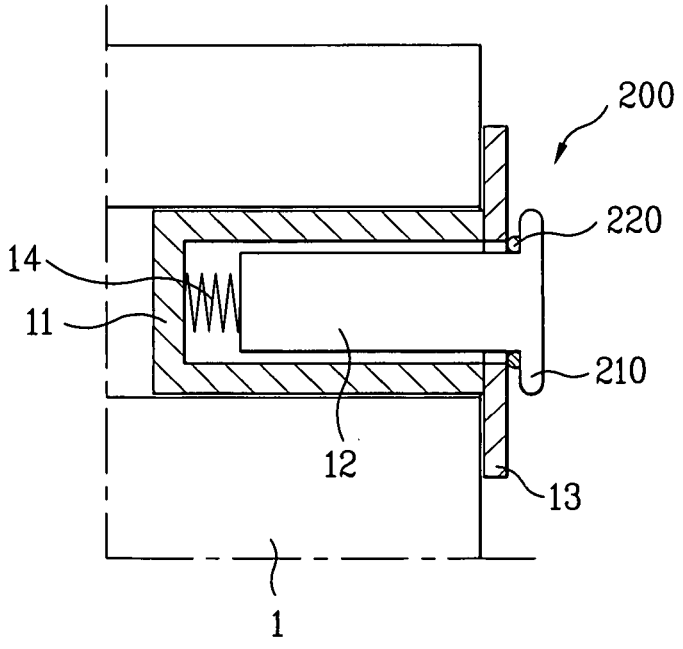

FIGS. 5A and 5B illustrate the sealing mechanism according to the second embodiment of the present invention. As shown, the sealing mechanism according to the second embodiment of the present invention includes an extension portion 210 radially extended from the end of the plunger 12. As shown in FIG. 5B, if the plunger 12 is pushed by the door 2, the extension portion 210 closes the clearance between the plunger 12 and the cabinet 1, thereby preventing the water from entering the switch assembly. Also, a sealing member 220 may additionally be provided at the outer surface of the plunger 12 to adjoin the extension portion 210. A ring member having elasticity serves as the sealing member 220. The sealing member 220 has a diameter smaller than that of the plunger 12 to be tightly attached to the outer surface of the plunger 12. The sealing member 220 is interposed between the extension portion 210 and the cabinet 1 or the holder 13 to fully close the clearance. As shown in FIG. 5B, the extension portion 210 pressurizes the sealing member 220 to fully close the clearance when the plunger 12 is pushed, and prevents the sealing member 220 from being detached from the plunger 12.

Furthermore, the extension portion 210 may be formed in a single body with the plunger 12 or may separately be formed in the plunger 12. For more complete sealing, the extension portion 210 may be coated with a layer having an elastic material or may be made of an elastic material. In this case, the extension portion 210 can fully seal the clearance even without the sealing member 220.

Figure 6A:
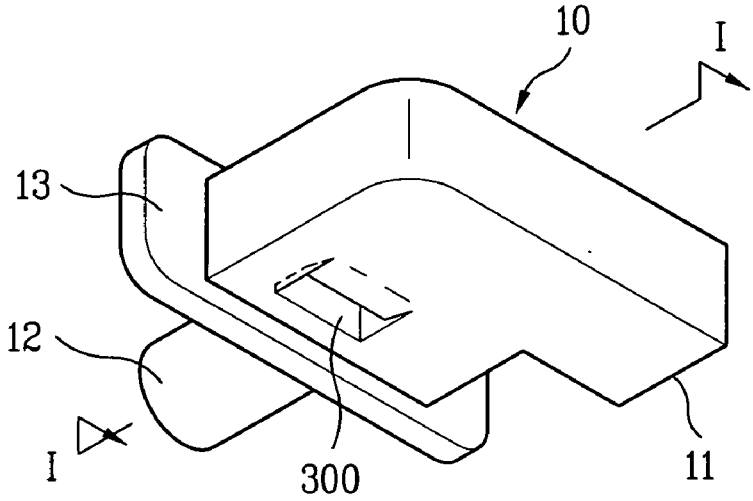
FIG. 6A is a bottom perspective view illustrating a sealing mechanism according to the third embodiment of the present invention.
Figure 6B:
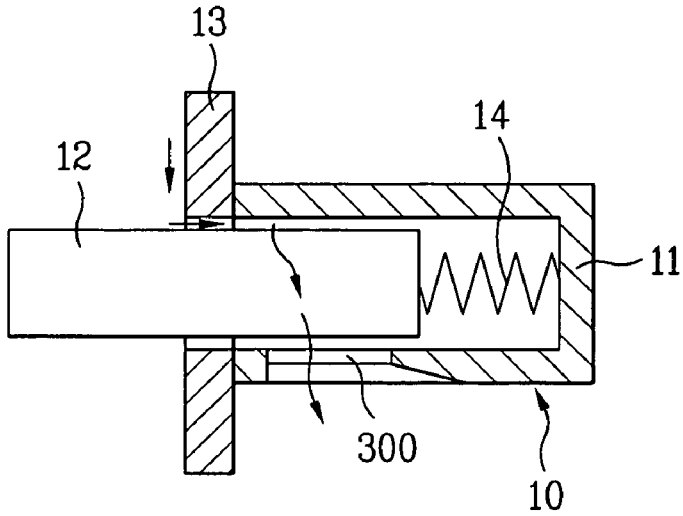
FIG. 6B is a sectional view taken along line I—I of FIG. 6A.

In the third embodiment of the present invention as shown in FIGS. 6A and 6B, the sealing mechanism includes an opening 300 formed at the lower portion of the housing 11. As shown in FIG. 6B, since the water is directly ejected from the switch assembly 10 through the opening 300, it is possible to avoid failure of the electrical switch, which may be caused by the water.

Figure 7:
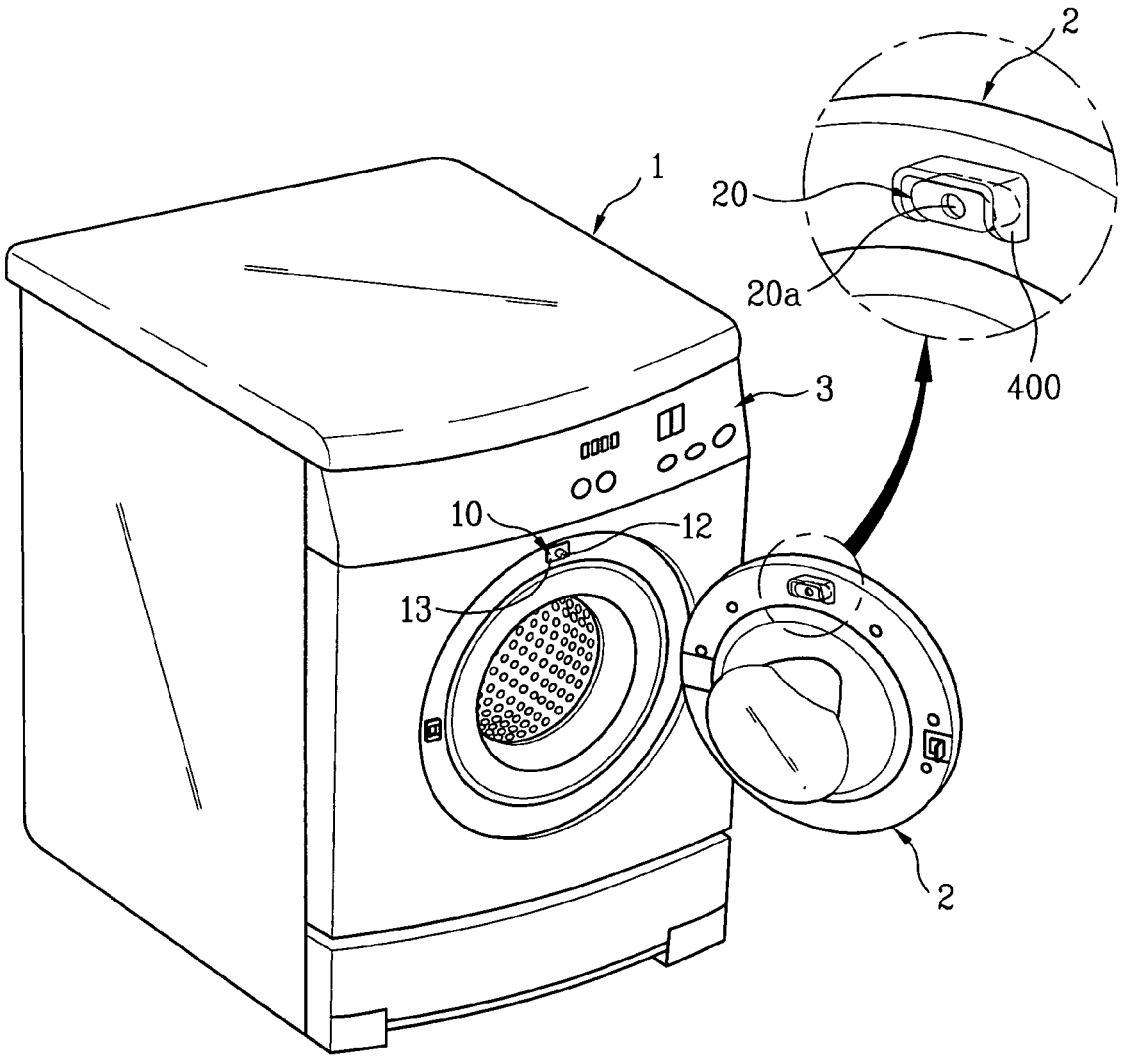
FIG. 7 illustrates a perspective view and a partial enlarged view of a sealing mechanism according to the fourth embodiment of the present invention.

Finally, as shown in FIG. 7, the sealing mechanism according to the fourth embodiment of the present invention includes a cover 400 provided around the push button 20 of the door 2. The cover 400 surrounds the switch assembly 10, particularly the plunger 12 when the door 2 is closed. In this case, the water is prevented from entering the clearance between the plunger 12 and the cabinet 1.

The cover 400 is protruded at a predetermined height to be tightly attached to the cabinet 1 when the door 2 is closed, and is provided to fully receive the exposed switch assembly 10. Since the cover 400 is to block the water flowing along the cabinet 1, it is preferably formed to surround both sides and the upper portion of the plunger 12 as shown. Preferably, the end of the cover 400 is rounded so as not to damage the cabinet 1.

As described above, since the sealing mechanism prevents the water from entering the switch assembly, the electrical switch inside the switch assembly or other electrical elements inside the washing machine and the dryer are operated without trouble. This improves reliability of the washing machine and the dryer.

The aforementioned sealing mechanism may be applied to various electronic appliances such as a refrigerator and a microwave oven with a similar switch assembly.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A door switch assembly for an appliance comprising:

a plunger movably provided in a cabinet of the appliance and pushed by a door to operate an electrical switch;

an elastic member provided in the appliance, and elastically supporting the plunger; and a sealing mechanism configured to prevent water from entering a clearance between the plunger and the cabinet, wherein the sealing mechanism is provided around the plunger and includes a guide member guiding the water to detour the clearance, and wherein the guide member includes a flange radially extended from the plunger and a hub extended toward the cabinet from the flange while surrounding the plunger.

2. The door switch assembly of claim 1, wherein the guide member forms a path that flows the water around the plunger.

3. The door switch assembly of claim 1, wherein the guide member has a channel section along with the cabinet.

4. The door switch assembly of claim 1, wherein the sealing mechanism includes an extension portion radially extended from the end of the plunger and a sealing member configured as a ring and provided on an outer surface of the plunger.

5. The door switch assembly of claim 4, wherein the sealing mechanism further includes a sealing member provided adjacent to the extension portion at the circumference of the plunger.

6. The door switch assembly of claim 5, wherein the appliance is a washing machine or a dryer.

7. The door switch assembly of claim 1, wherein the sealing mechanism includes an opening provided around the plunger to eject the water entering the clearance.

8. The door switch assembly of claim 7, wherein the opening is formed in a housing receiving the plunger and the elastic member.

9. The door switch assembly of claim 1, further comprising a holder provided in the cabinet to guide movement of the plunger.

10. The door switch assembly of claim 1, further comprising a housing provided in the cabinet to receive the plunger and the elastic member.

11. The door switch assembly of claim 1, wherein the appliance is a washing machine or a dryer.

12. A door switch assembly for an appliance comprising:

a plunger movably provided in a cabinet of the appliance and pushed by a door to operate an electrical switch;

an elastic member provided in the appliance, and elastically supporting the plunger; and a sealing mechanism configured to prevent water from entering a clearance between the plunger and the cabinet, wherein the sealing mechanism includes a cover formed in the door to surround the plunger when the plunger is pushed.

13. The door switch assembly of claim 12, wherein the cover is configured to surround an upper portion and sides of the plunger.

14. The door switch assembly of claim 12, wherein the appliance is a washing machine or a dryer.

15. A door switch assembly for a dryer comprising:

a plunger movably provided in a cabinet of the dryer and pushed by a door to operate an electrical switch;

an elastic member provided in the dryer, and elastically supporting the plunger; and a sealing mechanism configured to prevent water from entering a clearance between the plunger and the cabinet, wherein the sealing mechanism is provided around the plunger and includes a guide member guiding the water to detour the clearance, and wherein the guide member includes a flange radially extended from the plunger and a hub extended toward the cabinet from the flange while surrounding the plunger.

16. A door switch assembly for a dryer comprising:

a plunger movably provided in a cabinet of the dryer and pushed by a door to operate an electrical switch;

an elastic member provided in the dryer, and elastically supporting the plunger; and a sealing mechanism configured to prevent water from entering a clearance between the plunger and the cabinet, wherein the sealing mechanism includes a cover formed in the door to surround the plunger when the plunger is pushed.

17. The door switch assembly of claim 16, wherein the cover is configured to surround an upper portion and both sides of the plunger.

* * * * *